United States Patent [19]

Seefeld

[11] Patent Number: 4,517,911

[45] Date of Patent: May 21, 1985

[54] FLOTATION DEVICE

[76] Inventor: Wayne F. Seefeld, Rte. 1, Spencer, Wis. 54479

[21] Appl. No.: 601,908

[22] Filed: Apr. 19, 1984

[51] Int. Cl.[3] ..... B63B 7/00

[52] U.S. Cl. ..... 114/267; 114/266; 114/61; 114/63; 114/356

[58] Field of Search ..... 114/267, 266, 264, 263, 114/49, 61, 63, 356, 355

[56] References Cited

U.S. PATENT DOCUMENTS

| | | | |
|---|---|---|---|
| 404,150 | 5/1889 | Ammen . | |
| 3,034,155 | 5/1962 | Freeland . | |
| 3,090,339 | 5/1963 | Carr . | |
| 3,131,665 | 5/1964 | Kiekhaefer . | |
| 3,134,113 | 5/1964 | Boyington | 114/61 |
| 3,142,992 | 8/1964 | Beams | 114/61 |
| 3,179,960 | 4/1965 | Nimmo . | |
| 3,193,851 | 7/1965 | Fiebelkorn | 114/61 |
| 3,426,716 | 2/1969 | Hackworth | 114/61 |
| 3,465,486 | 9/1969 | Rolin | 114/61 |
| 3,614,937 | 10/1971 | Schulman . | |
| 3,785,317 | 1/1974 | Currey | 114/61 |
| 3,800,726 | 4/1974 | Murphy . | |
| 3,968,532 | 7/1976 | Bailey | 114/61 |
| 4,295,236 | 10/1981 | Upchurch | 114/61 |
| 4,303,033 | 12/1981 | King . | |

*Primary Examiner*—Trygve M. Blix
*Assistant Examiner*—C. T. Bartz
*Attorney, Agent, or Firm*—Isaksen, Lathrop, Esch, Hart & Clark

[57] ABSTRACT

A pontoon flotation device having forward and rearward ends and including at least two parallel pontoons fastened to a substantially rectangular deck panel. The deck panel has upturned side flanges extending the length of each side of the deck panel with a pontoon located parallel to and beneath each side of the deck panel. Each pontoon includes a substantially rectangular bottom panel and inner and outer upwardly extending side panels joined to opposite long edges of the bottom panel. The outer side panel extends upwardly beyond the furthest upward extension of the inner side panel to extend parallel and adjacent to a side flange of the deck panel. By this means, the deck panel and outer side panel of the pontoon are in position to be conveniently fastened to each other.

13 Claims, 7 Drawing Figures

Fig 1
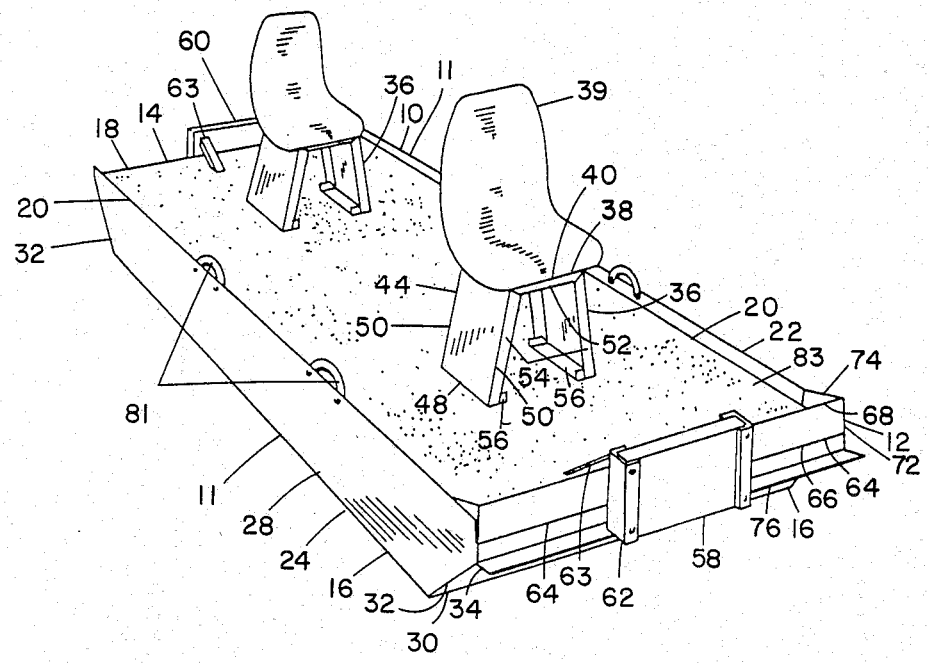
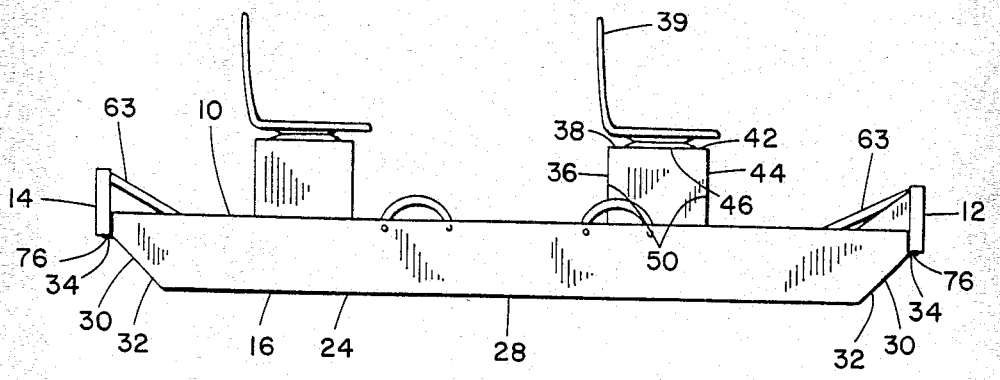
Fig 2

FLOTATION DEVICE

BACKGROUND OF THE INVENTION

The present invention relates to flotation devices having a double pontoon structure in general, and in particular, to blanks for the efficient construction of flotation devices from standard sized aluminum sheet material.

DESCRIPTION OF THE PRIOR ART

The prior art is generally cognizant of flotation devices having various kinds of pontoon structures. Examples of different kinds of pontoon structures are disclosed in U.S. Pat. No. 404,150 to Ammen, U.S. Pat. No. 3,034,155 to Freeland, U.S. Pat. No. 3,090,339 to Carr, U.S. Pat. No. 3,131,665 to Kiekhaefer, U.S. Pat. No. 3,179,960 to Nimmo, U.S. Pat. No. 3,614,937 to Schulman, and U.S. Pat. No. 4,303,033 to King. Most of the pontoon structures disclosed in the prior art are used as boats, with or without means for attaching an outboard motor. Some of the prior art pontoon structures are used as stationary floats or rafts. All of the pontoon structures cited above include a deck located near to water level, either supported on top of the pontoons or located between two pontoons. Because the deck of a pontoon structure often is close to water level, when the pontoon structure is used as a boat the passengers are in danger of getting wet. However, none of the prior art pontoon structures used as boats describe any means to keep the passengers from being splashed when the boat is propelled through the water.

Whether a pontoon structure is used as a boat or a float, it is important for the pontoon structure to be lightweight and easily assembled, and yet have sufficient strength and rigidity when assembled to assure the safety of the passengers. Although many of the prior art pontoon structures are lightweight, most are constructed from a multitude of components and therefore are complicated to assemble. Furthermore, a vital consideration in the financial success of a boat made from aluminum sheet material is the efficiency with which its parts may be cut from standard sizes of sheet stock. Even a strong boat of simple construction may prove unmarketable if its cost is driven up by waste in manufacture. The art is not cognizant of a pontoon boat specifically designed to be of a size and weight convenient for use and transporting that also can be made with desirable strength, rigidity, and simplicity of structure from stock commercial sizes of sheet material with negligible waste.

It has been a problem in the prior art to provide a lightweight, easily constructed pontoon structure to be used as a boat that has structural integrity and means to decrease splashing sufficient to ensure the safety and comfort of the passengers. It has also been a problem in the prior art to provide a means for constructing a pontoon structure by folding a relatively few number of flat aluminum blanks that in turn may be efficiently cut from standard sizes of aluminum with a minimum of scrap left over.

SUMMARY OF THE INVENTION

The present invention is summarized in that a flotation device having forward and rearward ends includes a plurality of parallel pontoons and a substantially rectangular deck panel supported on the pontoons. At least one seat stand adapted to support a seat is fastened to the deck panel and is adapted to substantially enclose a battery. A pair of transoms are located at opposite ends, forward and rearward, of the deck panel, each transom being adapted to support a motor. A splash guard is located at the forward end of the deck panel, the forward transom together with the splash guard being substantially as wide as the deck panel.

It is an object of the present invention to provide a pontoon flotation device which is lightweight and easily assembled.

It is another object of the present invention to provide such a flotation device having means to resist flexure around horizontal and vertical axes extending therethrough, so as to impart rigidity to the flotation device, thus ensuring passenger safety and comfort.

It is a further object of the present invention to provide such a flotation device having means to decrease splashing of water on passengers when the flotation device is propelled through the water.

It is a still further object of the present invention to provide one-piece blanks from which portions of the flotation device may be efficiently constructed from standard sized sheets of aluminum material.

Other objects, advantages, and features of the present invention will become apparent from the following specification when taken into conjunction with the accompanying drawings.

BRIEF DESCRIPTION OF THE DRAWINGS

FIG. 1 is a perspective view illustrating a pontoon flotation device constructed in accordance with the present invention.

FIG. 2 is a side elevation view of the pontoon flotation device of FIG. 1.

DESCRIPTION OF THE PREFERRED EMBODIMENTS

Figure 3:
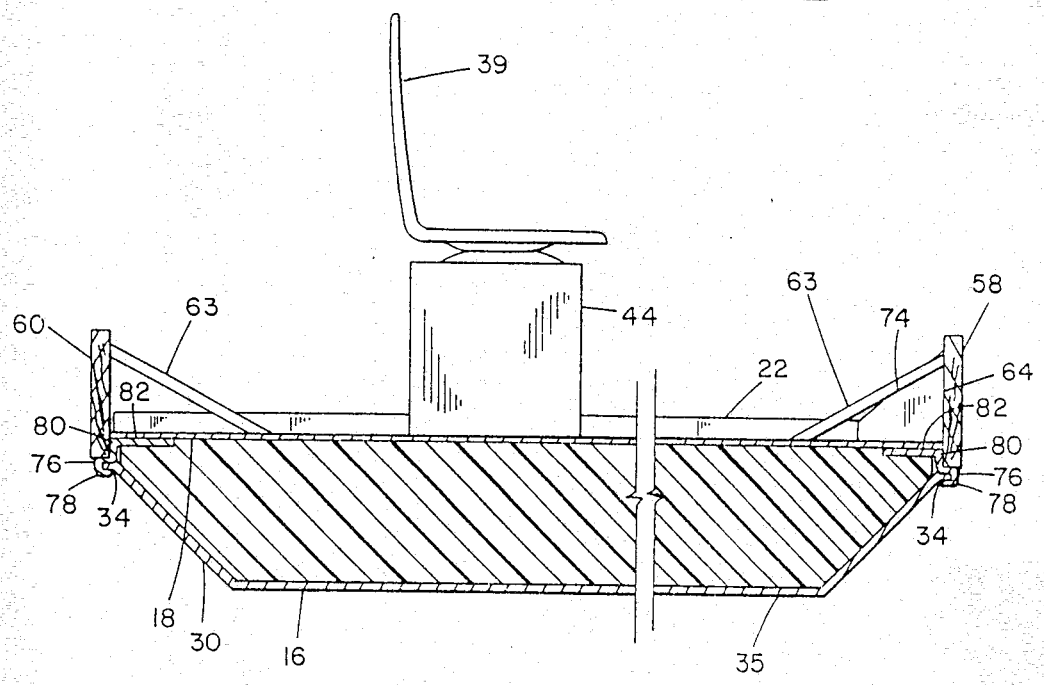
FIG. 3 is a cross-sectional view of the pontoon flotation device of FIG. 1 taken along section line 3—3.
Figure 4:
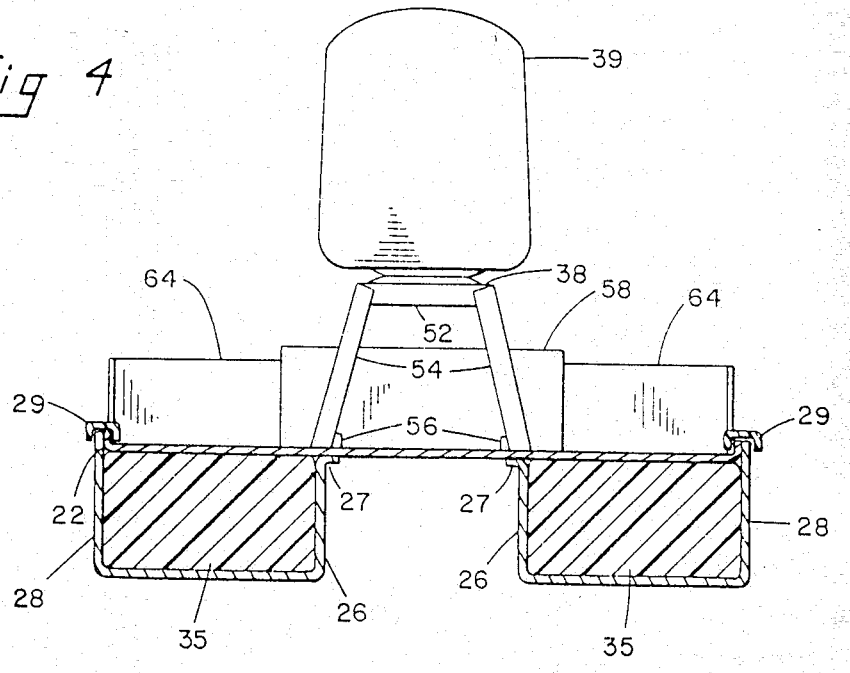
FIG. 4 is a cross-sectional view of the pontoon flotation device of FIG. 1 taken along section line 4—4.

Shown in FIGS. 1 and 2 is a pontoon flotation device, generally indicated at 10, constructed in accordance with the present invention. The pontoon flotation device has sides 11 and forward and rearward ends 12, 14. For convenience of description, all parts of the pontoon flotation device 10 will be referred to as having correspondingly oriented side, forward, and rearward parts, unless otherwise specified. The pontoon flotation device 10 includes a plurality of and preferably two parallel pontoons 16 that support a substantially rectangular deck panel 18. The deck panel 18 includes an upwardly presenting deck face 20 and upturned side flanges 22, one extending the length of each side of the deck panel 18.

Each pontoon 16 includes a substantially rectangular bottom panel 24 and inner and outer upwardly extending side panels 26 and 28, respectively, disposed on opposite long edges of the bottom panel 24. Each side panel 26 and 28 is substantially trapezoidal in shape and is attached by its shorter parallel edge to the long edge of the bottom panel 24. The longer parallel edge of each side panel 26 and 28 has a length substantially equal to the length of the deck panel 18. The pontoon 16 also includes a pair of substantially rectangular end panels 30 having side edges and end edges. One end panel 30 is associated with each short edge of the bottom panel 24 and is joined to the bottom panel 24 by an end edge. The end panels 30 extend upward and outward from the bottom panel 24 at an angle sufficient to align the end panels 30 between the endwardly presented end edges 32 of the side panels 26 and 28.

The outer side panel 28 extends upwardly beyond the furthest upward extension of the inner side panel 26, and is adapted to extend parallel and adjacent to a side flange 22 of the deck panel 18. The deck panel 18 and the outer side panel 28 may be conveniently fastened to each other by means of spot welding, rivets, or comparable fasteners passing through a side flange 22 and the upward margin of the adjacent outer side panel 28. Side caps 29 may be provided to cover the adjacent edges of the outer side panels 28 and associated side flanges 22.

Each inner side panel 26 has an inner ledge 27 attached to its longer parallel edge and extending in a direction away from the outer side panel 28. The inner ledge 27 is adapted to be generally parallel and adjacent to the underside of the deck face 20 when the pontoon 16 and deck panel 18 are in place, whereupon the inner side panel 26 may be conveniently fastened thereto with welds, rivets, or the like. Each pontoon end panel 30 includes an outwardly extending ledge 34 joined to that end edge of the end panel 30 which is remote from the bottom panel 24, at a level below that of the deck panel 18. Preferably each pontoon 16 is filled with a closed cell foam or other conventional flotation material indicated at 35.

The pontoon flotation device 10 further includes at least one and preferably two seat stands 36 supported on the deck panel 18. Each seat stand 36 includes a stand top 38 adapted to receive and support a conventional boat seat 39. The stand top 38 has end edges 40 and side edges 42. The stand top 38 has two stand top flanges 52 disposed on opposite end edges 40 of the stand top 38, the stand top flanges 52 being each folded downward from the stand top 38 to impart rigidity thereto. Each seat stand 36 further includes two stand sides 44 having top 46, bottom 48, and side edges 50. One stand side 44 is joined at its top edge 46 to each side edge 42 of the stand top 38. The stand sides 44 slope downward and outward from the stand top 38 to the deck panel 18 so as to accommodate a battery, not shown, between the two stand sides 44. Stand side reinforcement flanges 54 extend the length of the side edges 50 of the stand side 44 and are folded inwardly from the stand sides 44 to increase the rigidity thereof. A stand side bottom flange 56 extends the length of the bottom edge 48 of each stand side 44. The stand side bottom flanges 56 are folded inwardly from the associated stand side 44 so as to be parallel and adjacent to the deck face 20, whereupon the seat stand 36 may be conveniently fastened thereto.

The pontoon flotation device 10 further includes rearward and forward transoms 58, 60 located respectively at the forward and rearward ends of the deck panel 18. Each transom 58, 60 is adapted to support a motor. In normal use, a gasoline motor (not shown) would be attached to the rearward transom 58 for long distance travel and an electric trolling motor (not shown) would be attached to the forward transom 60, powered by means of a battery stored conveniently beneath a seat stand 36. The transoms 58, 60 may be made of wood or any suitable, strong material. When wood is used, it is convenient that the grain run horizontally and that the ends of the transoms 58, 60 be covered and supported by metal transom mounting channels 62. The transoms 58, 60 may each be braced by a pair of transom braces 63 extending at an angle from a convenient part of the transom inwardly with respect to the deck panel 18 to be fastened to the deck face 20.

The pontoon flotation device 10 further includes preferably a pair of splash guards 64 located at the forward end of the deck panel 18 on either side of the forward transom 58. The forward transom 58 and the splash guards 64 extend in combination substantially across the full width of the deck panel 18. Alternatively, a single splash guard extending the width of the deck panel 18 could be substituted for the preferred structure disclosed. Each splash guard 64 has a splash guard front face 66 having a top edge 68, a bottom edge 70, and side edges 72. A splash guard side extension 74 extends from one side edge 72 of the splash guard front face 66. The splash guard side extension 74 is folded at an angle to the splash guard front face 66 sufficient to be aligned with the side flange 22 of the deck panel 18 when the splash guard 64 is positioned on the forward end of the deck panel 18.

The pontoon flotation device 10 further includes a pair of end caps 76 having an length substantially equal to the width of the deck panel 18. As is best shown in FIG. 3, the end caps 76 include a substantially U-shaped pocket 78 adapted to snugly enclose the outwardly extending end panel ledges 34 of the pontoons 16, whereupon the end panel ledges 34 may be conveniently fastened to the U-shaped pocket 78 with welds, rivets, and the like. Extending upwardly from the end of the uppermost leg of the U-shaped pocket 78 is a brace member 80. A deck cap 82 extends from the brace member 80 at a point remote from the pocket 78 in a direction generally the same as that toward which the pocket opens. When the pocket 78 is in place over the end panel ledges 34, the deck cap 82 extends parallel and adjacent to the deck panel 18, whereupon the deck cap 82 may be conveniently fastened to the deck panel 18 with welds, rivets, and the like. The end caps 76 are thereby adapted to fasten the end panels 30 of the pontoons 16 to the deck panel 18. The U-shaped pocket 78 and the deck cap 82 resist flexure around vertical axes extending therethrough, and the brace member 80 resists flexure around horizontal axes extending therethrough to impart rigidity to the pontoon flotation device 10.

Preferably the pontoon flotation device 10 is equipped with side handles 81 attached to the pontoon flotation device with bolts passing through the side flanges 22 of the deck panel and upper margin of the adjacent outer side panel 28. In addition, it is preferred to cover the deck face 20 with a non-slip covering such as the conventional indoor-outdoor carpeting shown at 83.

Figure 5:
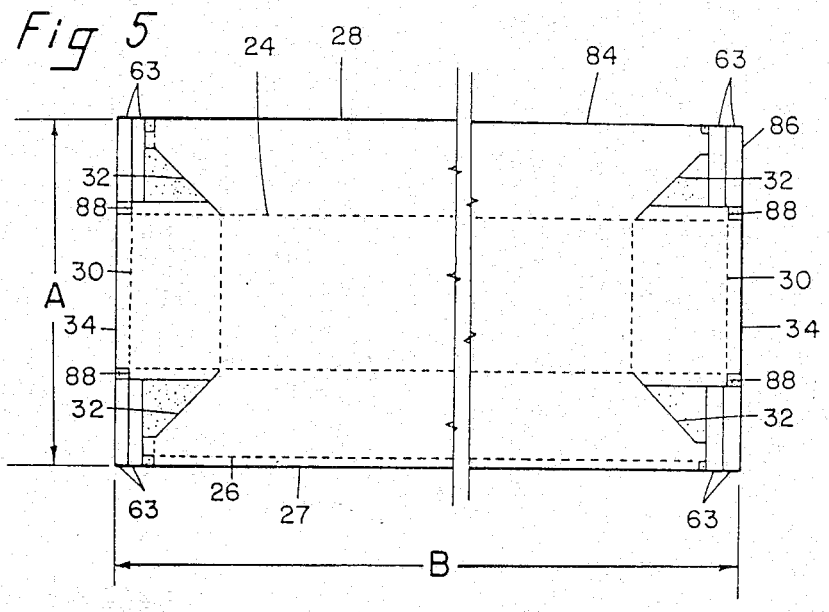
FIG. 5 is a plan view of a blank from which a pontoon of the pontoon flotation device of FIG. 1 may be constructed.
Figure 6:
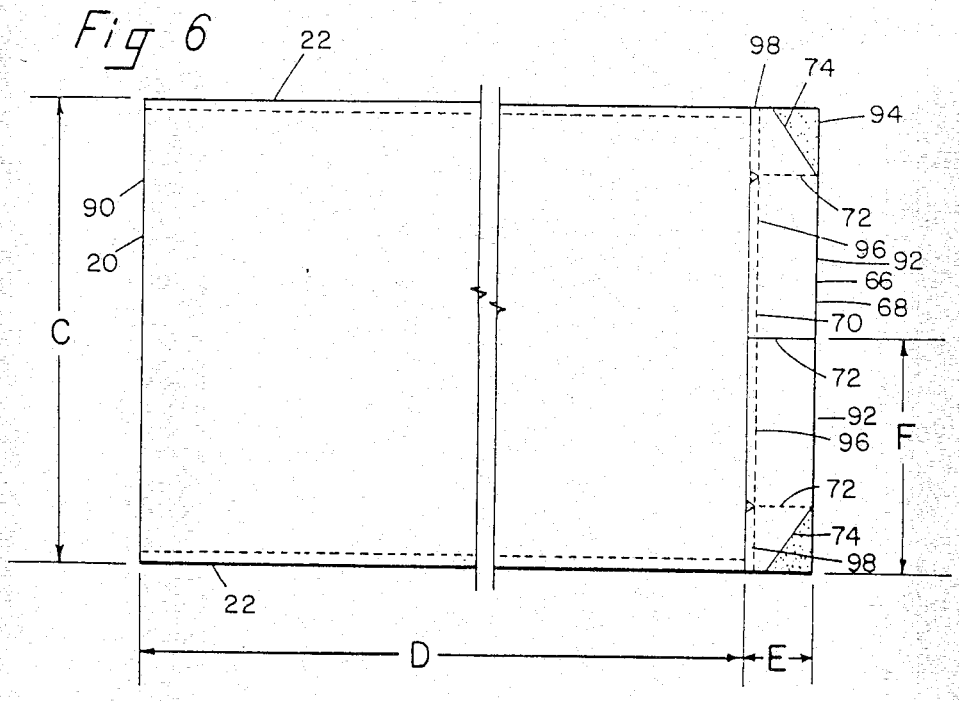
FIG. 6 is a plan view of a blank from which the deck panel and splash guards of the pontoon flotation device of FIG. 1 maybe constructed.
Figure 7:
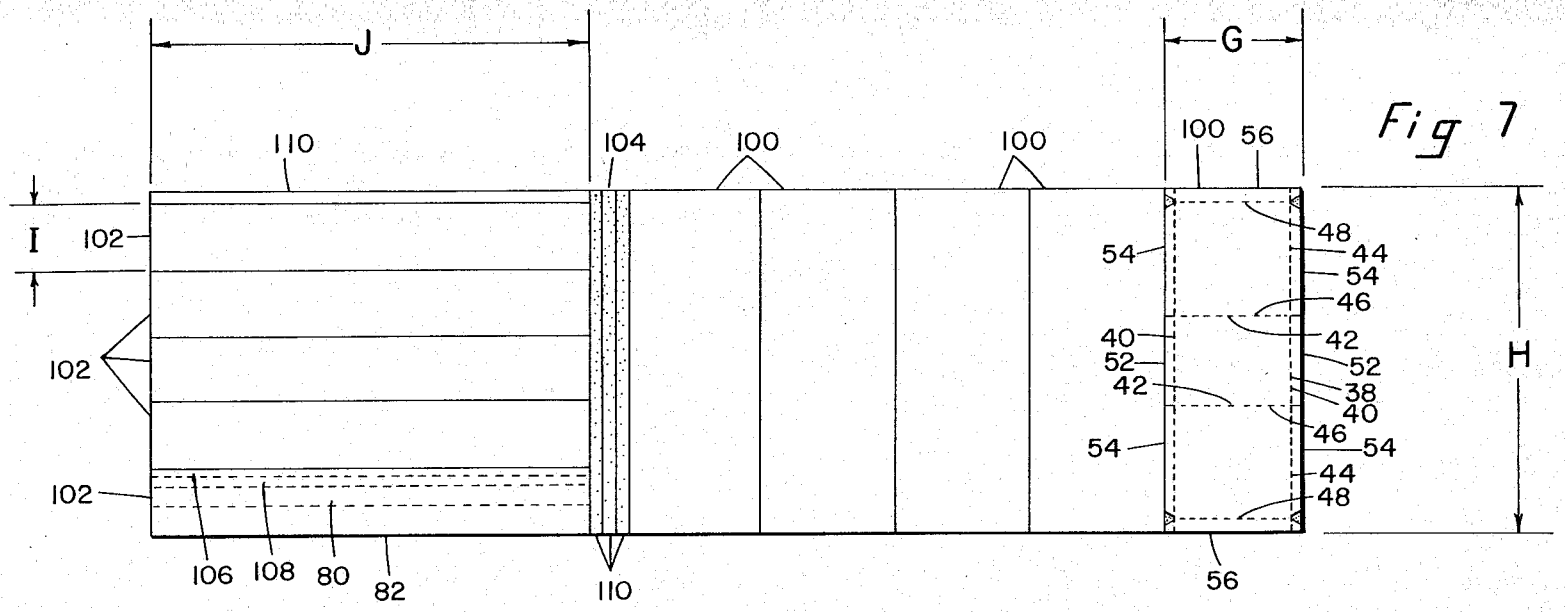
FIG. 7 is a plan view of a blank from which the seat stands and end caps of the pontoon flotation device of FIG. 1 may be constructed.

Sheet aluminum is supplied to the manufacturing industry in various standard sizes, including $4\times10$ foot and $3\times10$ foot sheets. The cost of an item made from sheet aluminum is importantly influenced by the amount of waste remaining after the parts for the item have been cut from such standard sheet sizes. As illustrated in FIGS. 5 through 7, the pontoon flotation device 10 of the present invention can be conveniently and efficiently constructed from a number of blanks cut from standard sizes of sheet aluminum. FIG. 5 illustrates a pontoon blank 84 marked out upon a substantially flat sheet of aluminum 86. The pontoon blank 84 includes a substantially rectangular bottom panel 24 and inner and outer substantially trapezoidal side panels 26, 28 joined by their shorter parallel edges to opposite long edges of the bottom panel 24. Each side panel 26, 28 has non-parallel, endwardly presented end edges 32. The side panels 26, 28 are each foldable upward at an angle of approximately 90° with respect to the bottom panel 24. Extending from the longer parallel edge of each inner side panel 26 is an inner ledge 27, which is foldable from the inner side panel 26 outward with respect to the finished pontoon 16. The outer side panel 28 of the pontoon blank 84 extends further from the bottom panel 24 than does the inner side panel 26, so that the outer side panel 28 of a pontoon 16 constructed therefrom extends upwardly beyond the furthest extension of the inner side panel 26.

The pontoon blank 84 further includes a pair of substantially rectangular end panels 30, one joined to each of the short edges of the bottom panel 24. Each end panel 30 is foldable upward from the bottom panel 24 at an angle sufficient to align the end panel 30 between the side panel end edges 32 adjacent thereto when the inner and outer side panels 26, 28 are folded upward to form the pontoon 16. An end panel ledge 34 extends from the end edge of each end panel 30 remote from the bottom panel 24. The end panel ledges 34 are foldable downward from their respective pontoon end panels 30 preferably to extend generally parallel to the bottom panel 24 in the finished pontoon 16. The pontoon blank 84 further includes side extensions 88 attached to each side edge of an end panel 30. The side extensions 88 are foldable toward the pontoon side panels 26, 28 to lie adjacent thereto in the finished pontoon 16. The end panels 30 and side panels 26, 28 thereby may be conveniently fastened together, preferably by welding, riveting or the like..

The pontoon blank 84 of the preferred embodiment has dimensions of approximately 36 inches by 120 inches, illustrated at A and B in FIG. 5. Preferably the bottom panel 24 is approximately 98 inches by 16 inches, the end panels 30 are 10 inches by 16 inches, and the end panel ledges 34 are 16 inches by 1 inch. The inner side panel 26 is approximately 9 inches wide. The outer side panel 28 is approximately 10 inches wide. The inner side panel ledge 27 is approximately 1 inch wide. Therefore, one pontoon blank 84 may be cut from one standard 36 inch by 120 inch sheet of aluminum 86 with minimal wast-age of the aluminum. The wastage is illustrated by the shading for aluminum in FIG. 5. Even this wastage may be reduced by cutting transom braces 63 one and three-fourths by nine inches in size from the scrap aluminum, as is shown in FIG. 5.

FIG. 6 illustrates a deck panel blank 90 and a pair of splash guard blanks 92 marked out upon a standard size sheet of aluminum 94. The deck panel blank 90 includes a substantially rectangular deck face 20 and a pair of deck panel side flanges 22, each joined to and foldable upward from opposite long edges of the deck face 20.

The splash guard blank 92 includes a substantially rectangular splash guard front face 66 having a top edge 68, a bottom edge 70, and side edges 72. A splash guard front face flange 96 extends from the bottom edge 70 of the splash guard front face 66 and is foldable with regard thereto, preferably at a 90° angle. A splash guard side extension 74 extends from one side edge 72 of the splash guard front face 62 and is foldable with respect thereto preferably at a 90° angle. A splash guard side extension flange 98 extends from that edge of the splash guard side extension 74 that is adjacent to the splash guard front face flange 96. The side extension flange 98 is foldable from the side extension 74 to be coplanar with the splash guard front face flange 96 when the preferred folds disclosed above are made.

The deck panel blank has dimensions approximately equal to 48 inches by 113 inches, as indicated at C and D in FIG. 6. Each splash guard blank has dimensions approximately equal to 7 inches by 24 inches, as indicated at E and F in FIG. 6. Therefore, one deck panel blank together with two splash guard blanks may be cut from one standard 48 inch by 120 inch sheet of aluminum 94 with minimum wastage of the sheet aluminum. The wastage is illustrated by the shading for aluminum shown in FIG. 6.

FIG. 7 illustrates a plurality of seat stand blanks 100 and a plurality of end cap blanks 102 marked out upon a standard size sheet of aluminum 104. Each seat stand blank 100 includes a substantially rectangular stand top 38 having end edges 40 and side edges 42. Stand top flanges 52 extend from the end edges 40 of the stand top 38. The stand top flanges 52 are each foldable downward from the stand top 38 to impart rigidity thereto. The seat stand blank further includes two stand sides 44 each having a top edge 46, a bottom edge 48, and side edges 50. The stand sides 44 are joined at their top edges 46 to opposite side edges 42 of the stand top 38. The stand sides 44 are foldable downward from the stand top 38. Stand side reinforcement flanges 54 extend from the side edges 50 of the stand sides 44. The stand side reinforcement flanges 54 are foldable inward from the stand sides 44 to render them rigid. A stand side bottom flange 56 extends the length of the bottom edge 48 of each stand side 44. The stand side bottom flanges 56 are each foldable inward from the stand side 44 to be generally parallel to the stand top 38.

The end cap blanks 102 each include substantially rectangular first and second strips 106, 108, each having a length substantially equal to the width of the deck panel 18. The second strip 108 extends at one of its long edges from a long edge of the first strip 106, the first and second strips 106, 108 being foldable relative to each other to form a U-shaped pocket 78 adapted to snugly enclose the outwardly extending ledges 34 of the pontoon end panels 30. A rectangular brace member 80 having a length substantially equal to the width of the deck panel 18 extends at one of its long edges from that long edge of the second strip 108 remote from the first strip 106. The brace member 80 is foldable with respect to the second strip 108 when the end cap 76 is constructed. A generally rectangular deck cap 82 having a length substantially equal to the width of the deck panel 18 extends at one of its long edges from the long edge of the brace member 80 remote from the second strip 108. The deck cap 82 is foldable with respect to the brace member 80 so that when the end cap 76 is constructed, the deck cap 82 is generally parallel to the U-shaped pocket 78 and extends from the brace member 80 in a direction opposite to that of the U-shaped pocket.

The seat stand blank 100 is approximately 14 inches by 36 inches in size, as illustrated in FIG. 7 at G and H.

The end cap blank 102 is approximately 7 inches by 46 inches in size, as illustrated in FIG. 7 at I and J. Therefore, five seat stand blanks 100 together with five end cap blanks 102 can be cut from one standard size 36 inch by 120 inch sheet of aluminum 104 with minimal waste. What would otherwise be waste may be reduced by cutting trim pieces 110 from the scrap aluminum, as is shown in FIG. 7. The trim pieces 110 can be used to trim the exposed edges of the carpet 83 and the like.

It will be apparent from the foregoing description that the pontoon flotation device 10 of the present invention may be easily assembled from a small number of blanks cut from sheet aluminum. Standard sizes of sheet aluminum may be used with negligible waste when the preferred dimensions disclosed above are used, to result in a pontoon boat approximately four by ten foot in size. An average of less than two pounds of waste aluminum results per boat. Such a boat may be carried conveniently in a conventional pick-up truck or even in a large station wagon, if the seats 39 are removed first. When made in this size, the pontoon flotation device 10 can carry two adults. Splash guards protect the passengers from water that might otherwise splash over the forward end 12 when the pontoon flotation device 10 is propelled through the water by a motor located on a transom. The unique device of the end caps 26 provides resistance to flexure around horizontal and vertical axes extending therethrough to impart rigidity to the pontoon flotation device even when relatively thin aluminum is used to construct the boat. By this means, both cost and weight may be low.

It is understood that the present invention is not limited to the particular construction and arrangement of parts disclosed and illustrated herein, but embraces all modified forms thereof as come within the scope of the following claims.

What is claimed is:

1. A pontoon flotation device having forward and rearward ends and comprising at least two parallel pontoons and a substantially rectangular deck panel extending lengthwise between the forward and rearward ends and supported on the pontoons, the deck panel having an upturned side flange extending the length of each side of the deck panel with a pontoon located parallel to and beneath each side of the deck panel, each pontoon including a substantially rectangular bottom panel and inner and outer upwardly extending side panels joined to opposite long edges of the bottom panel, the outer side panel extending upwardly beyond the furthest upward extension of the inner side panel to extend parallel and adjacent to a side flange of the deck panel, whereupon the deck panel and the outer side panel of the pontoon are in position to be conveniently fastened to each other.

2. The pontoon flotation device of claim 1 wherein the inner and outer side panels are each substantially trapezoidal in shape and are joined by their shorter parallel edges to the long edges of the bottom panel, the longer parallel edge of each side panel having a length substantially equal to the length of the deck panel; and wherein each pontoon includes rectangular end panels having side edges and end edges, an end panel being joined by an end edge to each short edge of the bottom panel, the end panels extending upward and outward from the bottom panel at an angle sufficient to align the end panels between the endwardly presented edges of the trapezoidal side panels; and an outwardly extending ledge attached to the end edge of each end panel remote from the bottom panel at a level below that of the deck panel;

the pontoon flotation device further including a pair of end caps having a length substantially equal to the width of the deck panel, the end caps including a substantially U-shaped pocket, the legs of the U-shaped pocket being adapted to snugly enclose the outwardly extending ledges to facilitate their being conveniently fastened within the U-shaped pocket, a brace member extending upwardly from the end of one leg of the U-shaped pocket, and a deck cap extending inwardly from the brace member parallel and adjacent to the deck panel to facilitate the convenient fastening of the deck cap to the deck panel, the end cap being thereby adapted to fasten the end panels of the pontoon to the deck panel, the U-shaped pocket and deck cap resisting flexure around vertical axes extending therethrough and the brace member resisting flexure around horizontal axes extending therethrough to impart rigidity to the pontoon flotation device.

3. The pontoon flotation device of claim 1 including at least one seat and at least one seat stand, the seat stand being supported on the deck panel and being adapted to support the seat and to substantially enclose a battery; the pontoon flotation device also including transoms located at the forward and rearward ends of the pontoon flotation device, each transom being adapted to support a motor, and splash guards located at the forward end of the pontoon flotation device and adapted to combine with any transom located at the forward end to extend substantially as wide as the deck panel.

4. The pontoon flotation device of claim 3 wherein each seat stand is integrally formed from sheet material and includes (a) a generally rectangular stand top; and (b) two stand sides which slope downward and outward from selected margins of the stand top to the deck panel, each stand side being extended for approximately the full length of the stand top margin from which it extends so as to accommodate and confine a battery between the two stand sides.

5. The pontoon flotation device of claim 2, wherein each pontoon is constructed from a blank having:

(a) a substantially rectangular bottom panel;

(b) inner and outer substantially trapezoidal side panels joined by their shorter parallel edges to opposite long edges of the bottom panel, the side panels each being foldable upward at an angle of approximately 90° with respect to the bottom panel;

(c) substantially rectangular end panels, one joined to each of the short edges of the bottom panel, the end panels being foldable upward from the bottom panel at an angle sufficient to align the end panels between the endwardly presented edges of the side panels; and (d) an end panel ledge extending from the end edge of each pontoon end panel remote from the bottom panel, the end panel ledges being foldable downward from their respective pontoon end panels.

6. The pontoon flotation device of claim 5 wherein the outer side panel of the pontoon blank is wider than the inner side panel so that the outer side panel of a pontoon constructed therefrom extends upwardly beyond the furthest extension of the inner side panel to be adapted to extend parallel and adjacent to one of the deck panel side flanges whereupon the deck panel and the pontoon outer side panel may be conveniently fastened together, the pontoon blank further including:

(a) side extensions joined to each side edge of the end panels, the side extensions being foldable toward the pontoon side panels to lie adjacent thereto whereupon the end panels and side panels may be conveniently fastened together; and (b) an inner ledge joined to the longer parallel edge of the inner side panel, the inner ledge being foldable from the inner side panel to be parallel and adjacent to the deck panel whereupon the inner side panel may be conveniently fastened thereto.

7. The pontoon flotation device of claim 6 wherein the pontoon blank has dimensions of approximately 36 inches by 120 inches so that one pontoon blank may be cut from one standard 36 inch by 120 inch sheet of aluminum with minimal wastage of the aluminum.

8. The pontoon flotation device of claim 7, wherein the deck panel is integrally formed from a blank having a substantially rectangular deck face and a pair of deck panel side flanges each joined to and foldable upward from opposite long edges of the deck face; and wherein each splash guard is integrally formed from a blank having:

(a) a splash guard front face having top, bottom, and side edges;

(b) a splash guard front face flange, extending from the bottom edge of the splash guard front face and foldable upward with respect thereto at an angle sufficient to be alignable with the deck face for convenient fastening of the splash guard thereto;

(c) a splash guard side extension joined to one side edge of the splash guard front face and foldable with relation thereto at an angle sufficient to be aligned with the side flange of the deck panel when the splash guard is positioned on the deck panel; and (d) a splash guard side extension flange joined to that edge of the side extension which is adapted to be adjacent to the deck face when the splash guard is mounted thereon, the side extension flange being foldable from the side extension to be parallel and adjacent to the deck face, whereupon the splash guard may be conveniently fastened thereto.

9. The pontoon flotation device of claim 8 wherein the deck panel blank has dimensions approximately equal to 48 inches by 113 inches and the splash guard blank has dimensions approximately equal to 7 inches by 24 inches so that one deck panel blank together with two splash guard blanks may be cut from one standard 48 inch by 120 inch sheet of aluminum with minimum wastage of the aluminum.

10. The pontoon flotation device of claim 2 wherein each end cap is constructed from a blank having:

(a) generally rectangular first and second strips each having a length substantially equal to the width of the deck panel, the second strip being joined at one long edge thereof to a long edge of the first strip, the second strip being foldable with respect to the first strip when the end cap is made so that the first and second strips together form the U-shaped pocket;

(b) a generally rectangular brace member having a length substantially equal to the width of the deck panel and joined at one long edge thereof to the long edge of the second strip remote from the first strip, the brace member being foldable with respect to the second strip; and (c) a generally rectangular deck cap having a length substantially equal to the width of the deck panel and joined at one long edge to the brace member at a point remote from the second strip, the deck cap being foldable with respect to the brace member so that, when the end cap is made, the deck cap is adapted to extend parallel and adjacent to the deck panel when the U-shaped pocket encloses the outwardly extending ledges.

11. The pontoon flotation device of claim 4, wherein each seat stand is integrally formed from a blank of sheet material having:

(a) a substantially rectangular stand top having end edges and side edges;

(b) stand top flanges extending from the end edges of the stand top, the stand top flanges each being foldable downward from the stand top to impart rigidity thereto;

(c) two stand sides having top, bottom, and side edges, each stand side joined at its top edge to one of the side edges of the stand top and extending for substantially the entire length thereof, the stand sides each being foldable downward from the stand top;

(d) stand side reinforcement flanges extending the length of the side edges of each stand side, the stand side reinforcement flanges being foldable inward from the stand sides to impart rigidity thereto; and (e) a stand side bottom flange extending the length of the bottom edge of each stand side, the stand side bottom flanges being foldable inward from the stand side to be parallel and adjacent to the deck face when the seat stand is placed thereon, whereupon the seat stand may be conveniently fastened thereto.

12. The pontoon flotation device of claim 11 wherein the rectangular bottom panel of each pontoon has two short edges, one presenting forwardly and one presenting rearwardly with respect to the pontoon flotation device, each pontoon further including rectangular end panels having end edges, an end panel being joined by an end edge to each short edge of the bottom panel to extend upward and outward therefrom at an selected angle, each pontoon further having an outwardly extending ledge attached to the end edge of each end panel remote from the bottom panel at a level below that of the deck panel, the pontoon flotation device further including an end cap having a length approximately equal to the width of the deck panel, the end cap including a substantially U-shaped pocket, the legs of the U-shaped pocket being adapted to snugly enclose, the outwardly extending ledge of a pontoon and to extend laterally with respect to the pontoon flotation device to also enclose the corresponding outwardly extending ledge of the other pontoon, and wherein the end cap is constructed from a blank having:

(a) generally rectangular first and second strips each having a length substantially equal to the width of the deck panel, the second strip being joined at one long edge thereof to a long edge of the first strip, the second strip being foldable with respect to the first strip when the end cap is made so that the first and second strips together form the U-shaped pocket;

(b) a generally rectangular brace member having a length substantially equal to the width of the deck panel and joined at one long edge thereof to the long edge of the second strip remote from the first strip, the brace member being foldable with respect to the second strip; and (c) a generally rectangular deck cap having a length substantially equal to the width of the deck panel and joined at one long edge to the brace member at a point remote from the second strip, the deck cap being foldable with respect to the brace member so that, when the end cap is made, the deck cap is adapted to extend parallel and adjacent to the deck panel when the U-shaped pocket encloses the outwardly extending ledges.

13. The pontoon flotation device of claim 12, wherein the seat stand blank has dimensions approximately equal to 14 inches by 36 inches and the end cap blank has dimensions approximately equal to 7 inches by 46 inches so that five seat stand blanks together with five end cap blanks can be cut from one standard 36 inch by 120 inch sheet of aluminum, with minimal wastage of the aluminum.

* * * * *